US007156004B1

(12) United States Patent
Whitehead et al.

(10) Patent No.: US 7,156,004 B1
(45) Date of Patent: Jan. 2, 2007

(54) ADJUSTABLE WRENCH FOR REMOVAL OF VEHICLE OIL FILTERS

(75) Inventors: Michael L. Whitehead, Clarinda, IA (US); Thomas J. Burrows, Elkhorn, WI (US)

(73) Assignee: Lisle Corporation, Clarinda, IA (US)

( * ) Notice: Subject to any disclaimer, the term of this patent is extended or adjusted under 35 U.S.C. 154(b) by 0 days.

(21) Appl. No.: 11/472,687

(22) Filed: Jun. 22, 2006

(51) Int. Cl.
*B25B 7/02* (2006.01)

(52) U.S. Cl. ..... 81/420; 81/423; 81/424.5

(58) Field of Classification Search ..... 81/420, 81/417, 416, 424.5, 176.15, 176.2, 64, 176.3, 81/68–70; 403/58; D8/21–23
See application file for complete search history.

(56) References Cited

U.S. PATENT DOCUMENTS

| | | | | | |
|---|---|---|---|---|---|
| 780,818 | A * | 1/1905 | Schlegle | ..... | 72/125 |
| D261,722 | S * | 11/1981 | Rocheleau | ..... | D8/22 |
| 5,207,131 | A | 5/1993 | Pool et al. | | |
| 5,255,579 | A * | 10/1993 | Fortin | ..... | 81/424 |
| 5,531,141 | A * | 7/1996 | Gilbert, Jr. | ..... | 81/426.5 |
| 5,590,573 | A * | 1/1997 | Detable | ..... | 81/9.3 |
| 5,595,094 | A | 1/1997 | Negus | | |
| 5,941,141 | A | 8/1999 | Whitley | | |
| 6,220,126 | B1 * | 4/2001 | Domenge | ..... | 81/418 |
| 6,389,937 | B1 * | 5/2002 | Kang | ..... | 81/423 |

OTHER PUBLICATIONS

Idea Disclosure Agreement No. 06-293, Stanley Simonds, for Swivel Grip Oil Filter Pliers.
Stanley Proto Spin-Flex Ratchets.
Thomas J. Burrows, Invention Disclosure Agreement, May 19, 1997.

* cited by examiner

*Primary Examiner*—Lee D. Wilson
*Assistant Examiner*—Anthony Ojini
(74) *Attorney, Agent, or Firm*—Banner & Witcoff, Ltd.

(57) ABSTRACT

An adjustable wrench for gripping and rotation of a generally cylindrical canister, such as an oil filter canister, includes handles which are pivotally connected to each other for rotation about a first axis. Each handle is also connected by an articulatable joint to a gripping jaw that may be positioned about the canister or body, to thereby alter the angle of the handles with respect to the jaws in order to enable use of the tool in confined spaces.

8 Claims, 5 Drawing Sheets

10
40
46
50
42
44
48
54
56
25
23
21
19
15
17
11

ADJUSTABLE WRENCH FOR REMOVAL OF VEHICLE OIL FILTERS

BACKGROUND OF THE INVENTION

The invention relates to an oil filter wrench and, more particularly, to an oil filter wrench in the form of a pliers type tool that is capable of use in restricted areas. The tool includes a pair of pivotally connected actuating handles, each of which is connected by an articulating joint to a jaw member that is designed to grip an oil filter canister or other similarly shaped body.

Oil filter wrenches in the form of pliers having a pair of handles connected to arcuate gripping jaws have been commercially available for a number of years. The arcuate jaws typically include projecting teeth or ribs that serve as gripping members when the jaws are fitted and clamped around a cylindrical oil filter or canister. The wrench is then rotated in order to effect removal from an engine block, for example. Such wrenches are available in various sizes and configurations. U.S. Pat. No. 5,595,094, issued Jan. 21, 1997 for an Oil Filter Wrench, incorporated herewith by reference, depicts a type of wrench that is very useful for the removal of an oil filter from an engine.

A problem that may be encountered, particularly in vehicles having a smaller engine compartment, involves access to the cylindrical oil filter. Long handled wrenches often cannot be inserted and positioned appropriately in the engine compartment to enable gripping, turning or axial twisting of the wrench tool to remove the filter. Thus, in limited access situations, an oil filter wrench of the type, for example, as depicted in U.S. Pat. No. 5,595,094 is not always easy to use. As a consequence, there has developed a need for an oil filter wrench useful in restricted or confined areas. Such a tool is also considered useful for removal or gripping and turning of any cylindrical or generally cylindrical body mounted particularly in a restricted space as well as in unrestricted space.

SUMMARY OF THE INVENTION

In the principal aspect, the present invention comprises an oil filter wrench or a pliers type tool which includes first and second pivotally connected handles, joined respectively to a first and a second jaw member through an articulated connection or joint which enables each of the jaw members to be articulated or pivoted with respect to their respective, connected handle member. Thus, the first and second handle members are each connected through a pivot connection to a corresponding jaw member. The angle of inclination of the jaws or jaw members relative to the respective handle members may be adjusted to accommodate positioning of the jaws about a cylindrical type body in a confined space while simultaneously enabling a user to grip the handles of the tool. Preferably, each jaw member is adjustable to any one of a series of detent positions relative to the associated handle member. In this manner, each of the jaw members can be set at an appropriate angle relative to the associated handle member and then positioned to grip, twist or turn a cylindrical body member.

Thus, it is an object of the invention to provide an improved tool for removal and replacement of cylindrical type bodies, such as oil filters mounted on an engine block.

It is a further object of the invention to provide an adjustable wrench for gripping generally cylindrical canisters, such as oil filters mounted on an engine block. Such a wrench may have the additional capability of gripping various shapes.

Yet another object of the invention is to provide a wrench tool wherein the separate jaws of the wrench are adjustable independently from one another with respect to a handle associated with each of the separate jaws of the wrench or pliers type tool.

Another object of the invention is to provide a pliers or wrench type tool wherein the jaws are adjustable to permit adjustment of the angle of attachment of a jaw and respective handle.

A further object of the invention is to provide adjustable attachment of jaw and handle members together wherein the adjustable attachment incorporates a detent mechanism that enables maintenance of a desired angular relationship between a jaw and a handle.

A further object of the invention is to provide a rugged yet economical and highly utilitarian wrench or pliers type tool which may be used for engaging, gripping and rotating generally cylindrical bodies.

These and other objects' advantages and features of the invention will be set forth in the Detailed Description which follows.

BRIEF DESCRIPTION OF THE DRAWING

In the detailed description which follows, reference will be made to the drawing comprised of the following figures.

DESCRIPTION OF PREFERRED EMBODIMENTS

Figure 1:
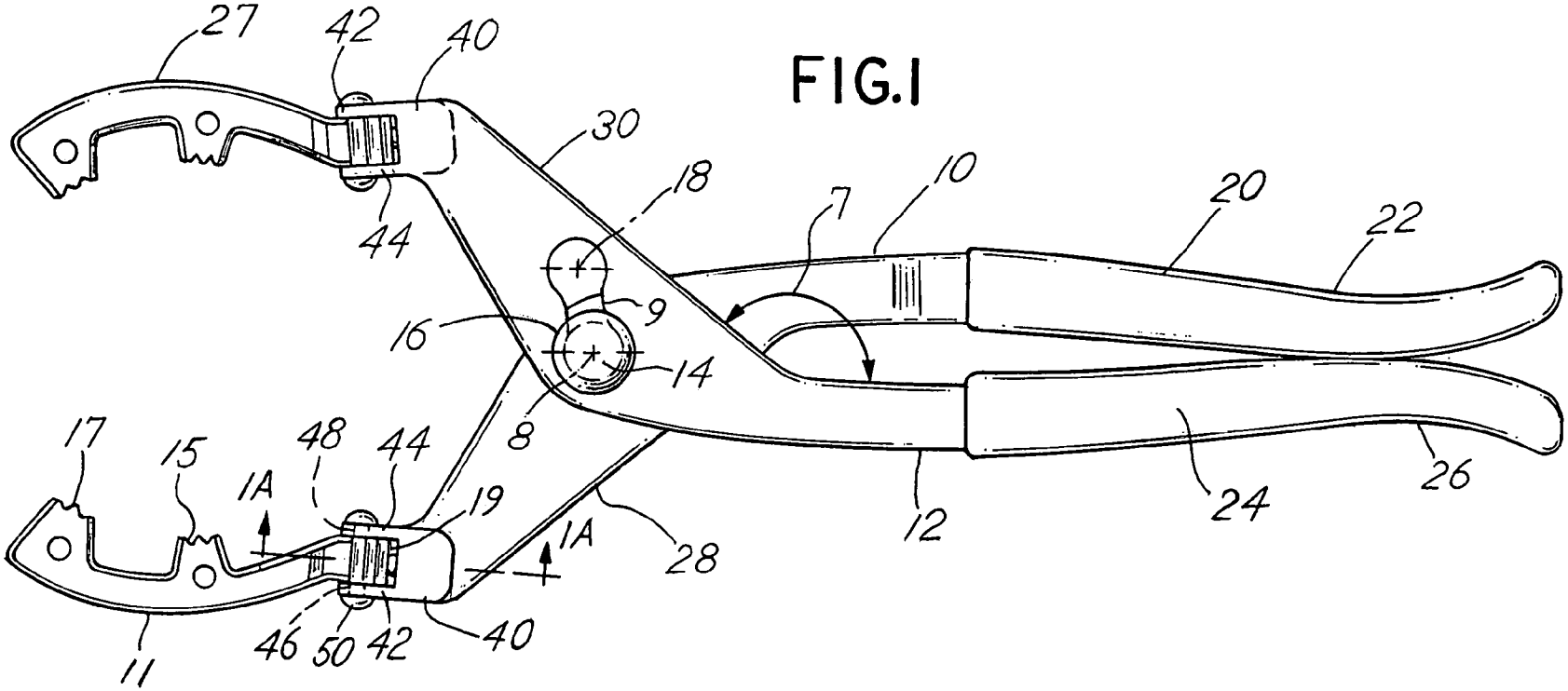
FIG. 1 is a plan view of an embodiment of the tool wherein the jaws and handles of the tool are in a generally coplanar condition.
Figure 1A:
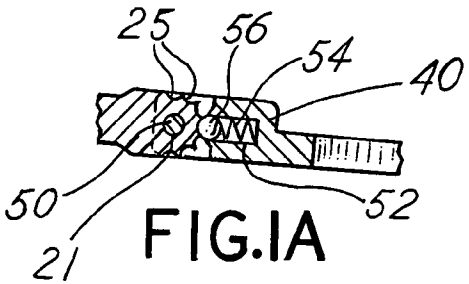
FIG. 1A is a partial cross sectional view of the detent construction of the tool of FIG. 1 taken along the line 1A—1A in FIG. 1
Figures 2, 3:
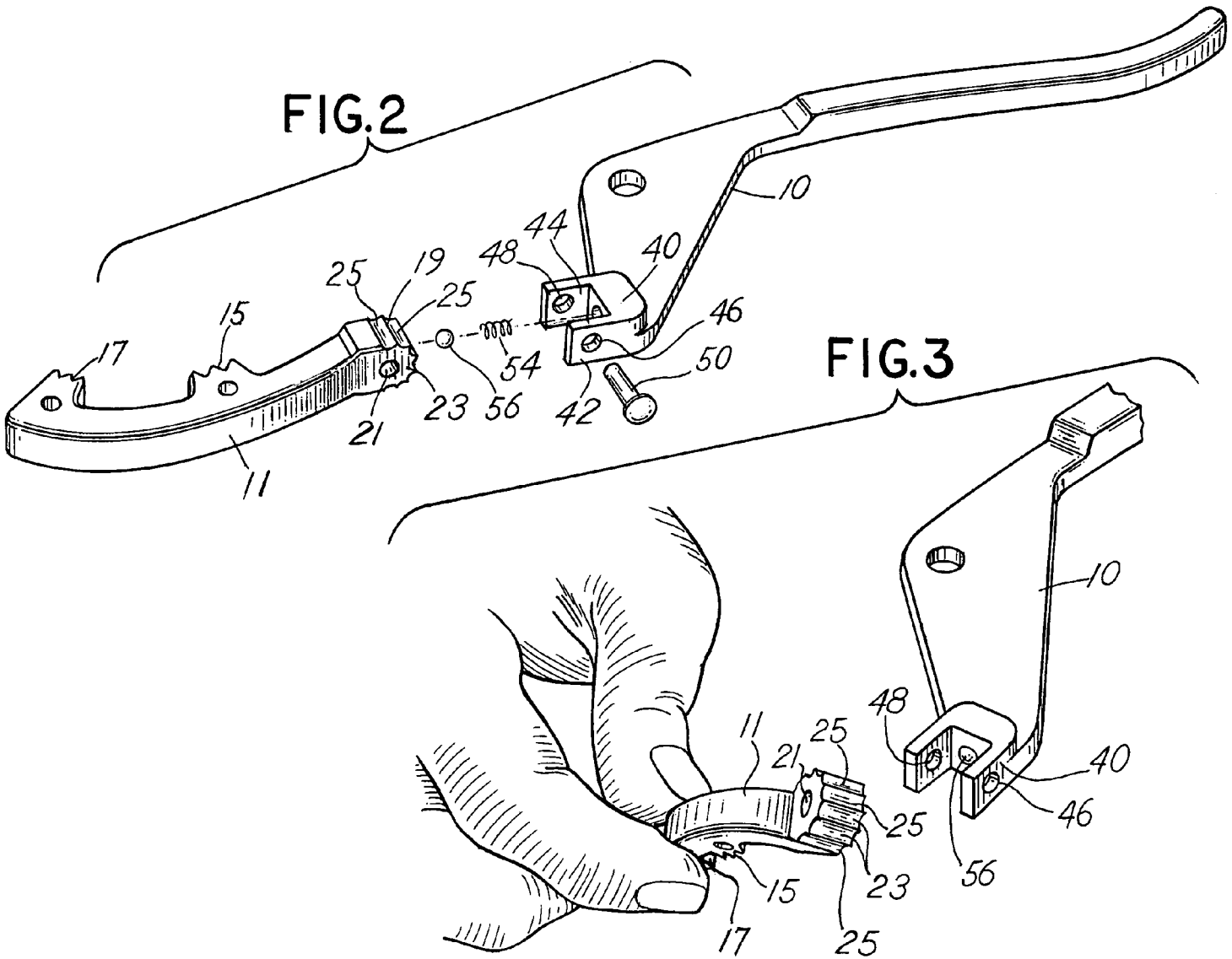
FIG. 2 is an exploded isometric view of the tool of FIG. 1.
FIG. 3 is an enlarged, exploded, isometric view of the component parts of the tool of FIG. 1 forming the articulating connection between the jaws and handles of the tool.

Referring to the drawings, an embodiment of the pliers type wrench tool of the invention is comprised of a first handle 10 and a second handle 12. Handles 10, 12 are joined together at a pivot connection 14 by a pivot pin 16. The pivot connection 14 is adjustable between a first pivot connection axis 8 and a second pivot connection axis 18. Pin 16 projecting from handle 10 may thus be moved in a slot 9 between axis 8 and axis 18 to effect adjustment of the potential width of the opening of the jaws of the tool described hereinafter.

The first handle 10 includes an elongate, generally linear handle section 20 with a grip 22 attached thereto at the distal end. The second handle 12, likewise, includes an elongate section, 24 with an end hand grip 26 attached thereto. The first handle 10 includes a forward angled section 28. Similarly, the second handle 12 includes a forward angled section 30. The angle 7 of inclination between the angled sections 28, 30 and the respective elongate sections 20, 24 forming the handles 10 and 12 is in the range of 25° to 60°.

The handles 10 and 12, are generally mirror images of each other but for the pivot connection axes 8 and 18. Each of the handles 10 and 12 includes a forward or outer end 40 term nating the angled section 28, 30 comprising a projecting, bifurcated bracket including first and second parallel, spaced connection plates 42 and 44. Each plate 42, 44 includes a passage 46 and 48, respectively, extending therethrough for receipt of a mounting pin 50. A pivot axis of pin 50, is generally transverse to the axes 8 and 18. A cylindrical counterbore 52 is defined in the outer end 40 between plates 42, 44. The cylindrical counterbore 52 is sized to receive a biasing, spiral spring 54, and a detent ball 56, which is peened into place in counterbore 52 or alternatively, which may be retained in the counterbore 52 by the assembly of the jaw (e.g. 11) to a handle (e.g. handle 10).

The first handle 10 is cooperative with a separate first jaw 11. The jaw 11 includes an arcuate section and inwardly projecting gripping teeth, 15 and 17. Further, the first jaw 11 includes a inside connecting end 19 with a through passage 21 for receipt of the pin 50. An arcuate outer surface 23 at connecting end 19 includes a series of detent openings 25, preferably slots 25. However, semi-spherical openings may be utilized. In this manner, the first jaw 11 can be pivotally mounted at the outer end 40 of the first handle 10 by pin 50. Due to the cooperative action of the detent ball 56 with slots or the detents 25, the angle of the connection between the first handle 10 and the first jaw 11 may be adjusted and fixed in a desired articulated or angled position.

In like fashion, the second handle 12 includes a second jaw or jaw member 27, which is arcuate in shape and comprises a generally mirror image version of the first jaw 11. Thus, the description associated with the second jaw 27 generally applies to that which is set forth with respect to the first jaw 11.

Figure 4:
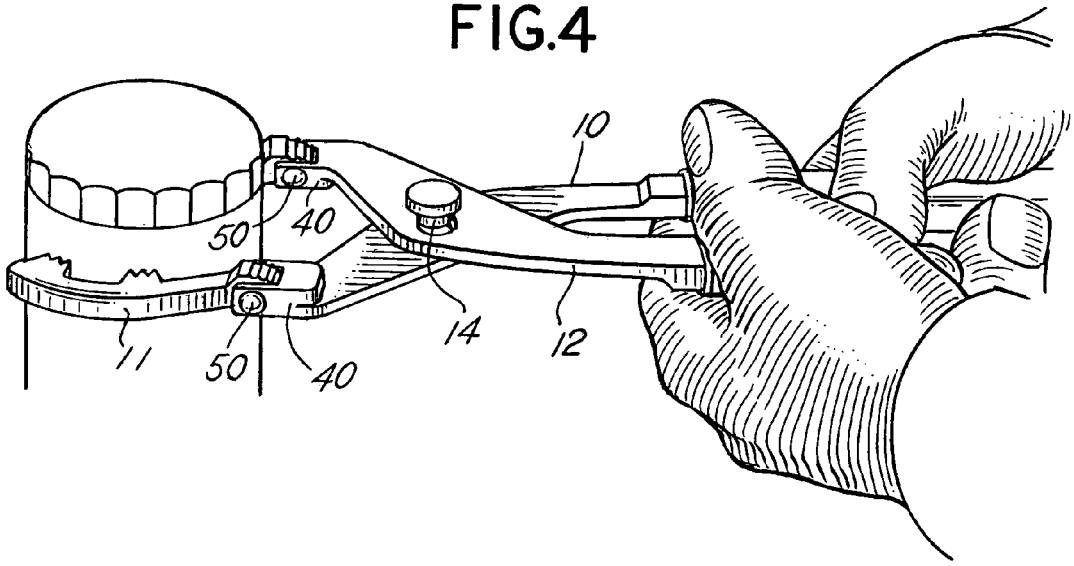
FIG. 4 is an isometric view of the tool of FIG. 1, wherein the tool is engaged with a canister and the handles and jaws of the tool are generally coplanar.
Figure 5:
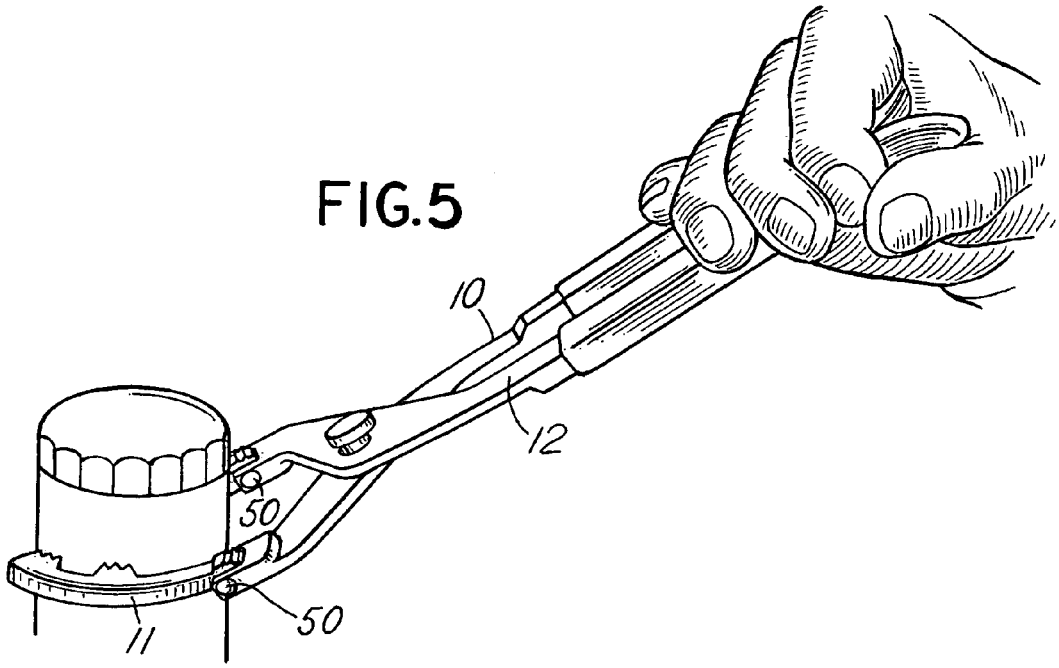
FIG. 5 is an isometric view of the tool of FIG. 1, wherein the tool is engaged with a canister and the handles are articulated with respect to the jaws.
Figure 6:
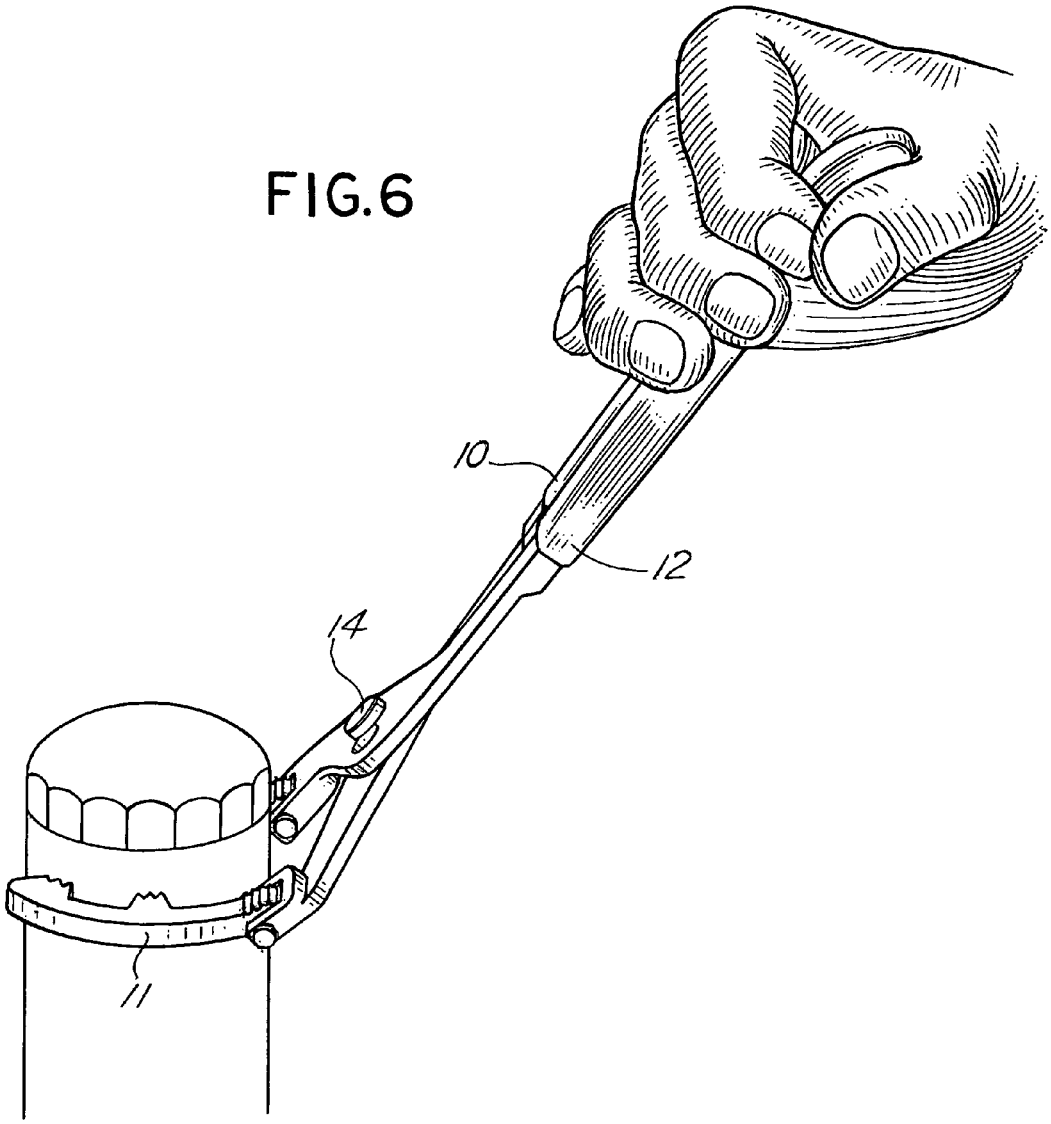
FIG. 6 is an isometric view of an alternate position of the elements of the embodiment of FIG. 1.

As a consequence of the construction, the jaws 11 and 27 may be aligned to be coplanar with the handles 10 and 12 for example, as depicted in FIG. 4. Alternatively, the handles 10 and 12 may be articulated with respect to the jaws 11 and 27 so that the tool may be inserted into restricted spaces as illustrated in FIG. 5 or 6.

It is to be noted that the connection between the jaws 11 and 27 and the handles 10 and 12 is effected, in the embodiment depicted, at the outer end 40 of the handles 10, 12. That is, a pivot connection 14 and pin 16 connects the handles 10, 12, and the angular extension section 30 and 28 lie in the same plane of handles 10, 12 and are thus integral with the handles 10, 12. The pivot connections between the jaws 11, 27 and the handles 10, 12 are at an outer end 40. These connections are on the opposite side of the pivot connection 14 of the handle sections 20 and 24.

Figure 7:
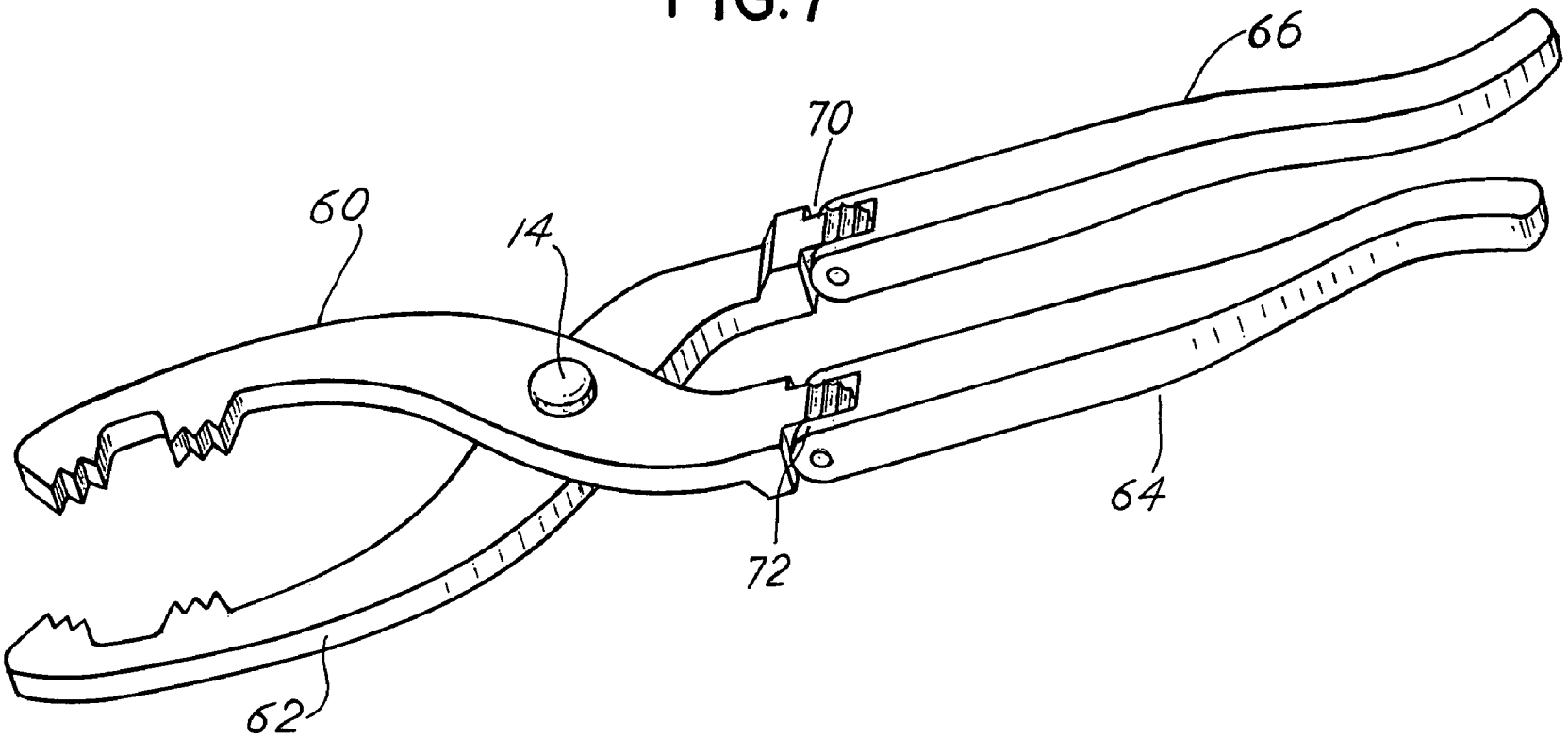
FIG. 7 is an isometric view of an alternative embodiment of the invention.

However jaws 60, 62 and handles 64, 66 pivot connections 70, 72 may be incorporated on the opposite side of a pivot connection 14, as depicted in FIG. 7. Thus, alternative embodiments may be adopted wherein the pivot connection of the jaws to the handles can be placed on either side of the central pivot axes 8 and 18 and pivot connection 14.

Other changes and alterations may be effected without departing from the spirit and scope of the invention including distinctive means for maintaining the jaws 11, 27 in various detent positions with respect to the respective handles 10, 12 in addition to coacting balls and slots or semi-spherical openings. The invention is therefore to be limited only by the following claims or equivalents thereof.

What is claimed is:

1. An adjustable wrench for gripping and rotation of a generally cylindrical canister comprising, in combination:

a first hand grip handle having a hand grip end, a jaw attachment end and a pivot connection intermediate the hand grip end and the jaw attachment end;

a second hand grip handle having a hand grip end, a jaw attachment end and a pivot connection intermediate the hand grip end and jaw attachment end of said second hand grip handle;

said first and second hand grip handles pivotally connected at their said pivot connections, the hand grip handles being substantially coplanar and pivotal about their pivot connections;

a first, separate, canister gripping jaw having an attachment end, and a generally arcuate gripping arm extending from the first gripping jaw attachment end, said attachment end adjustably attached by a first pivot attachment mechanism to the first hand grip handle jaw attachment end for pivotal movement of said first gripping jaw between a position generally coplanar with the first and second hand grip handles and a non-coplanar position with respect to said handles; and a second separate component canister gripping jaw having an attachment end and a generally arcuate gripping arm extending from the second gripping jaw attachment end, said attachment end adjustably attached by a second pivot attachment mechanism to the second hand grip handle jaw attachment end for pivotal movement between a position generally coplanar with the first and second hand grip handles and a non-coplanar position with respect to said handles and said first and second gripping jaws comprising a clamping device with said jaws in opposed relation.

2. The wrench of claim 1 wherein the attachment mechanism for at least one of said gripping jaws includes a detent mechanism for positioning one of said jaws in a releasably fixed position on the attached handle.

3. The wrench of claim 2 wherein each of said gripping jaws includes a detent mechanism for generally positioning said jaws in a generally fixed position relative to the handle attached thereto.

4. The wrench of claim 3 wherein each of said gripping jaws is adjustable to more than one releasably fixed position.

5. The wrench of claim 4 wherein the gripping jaws are moveable to move more than one generally coplanar position.

6. The wrench of claim 1 wherein the first and second handles and first and second jaws are generally mirror images of each other on a plane through the handle pivot connection.

7. The wrench of claim 2 wherein the detent mechanism comprises a biased detent member on the attachment end of said one grip handle and a plurality of spaced, detent openings in an arcuate surface at the attachment end of the associated gripping jaw.

8. An adjustable wrench for gripping a generally cylindrical canister and turning said canister about an axis, said wrench comprising, in combination:

first and second curved jaw members, each member including a curved inside gripping face with a plurality of gripping teeth projecting from said inside face, said gripping faces in opposed, generally coplanar array for gripping an item intermediate said faces;

first and second grip handles connected respectively to said first and second jaw members, said first jaw member and said first grip handle in combination fitted over and pivotally attached to said second jaw member and said second grip handle by a pivot connection for pivotal movement about a first axis, to effect clamping of the jaw members by displacement of the grip handles toward each other;

said first jaw member further connected to said first grip handle by a second adjustable pivot connection for pivoting about a second axis generally transverse to the first axis;

said second jaw member further connected to said second grip handle by a third adjustable pivot connection for pivoting about a third axis generally transverse to the first axis; and detent elements for said second and third pivot connection for maintaining the angle of articulation of each jaw member to the attached grip handle.

* * * * *